US006320308B1

(12) United States Patent
Mulieri

(10) Patent No.: US 6,320,308 B1
(45) Date of Patent: Nov. 20, 2001

(54) OPTIMIZING THE GENERATION OF VISIBLE LIGHT PRODUCED BY MERCURY ARC VAPOR AND FLUORESCENT LAMPS

(75) Inventor: Norberto Miguel Mulieri, Buenos Aires (AR)

(73) Assignee: Norvic LLC, Westport, CT (US)

( * ) Notice: Subject to any disclaimer, the term of this patent is extended or adjusted under 35 U.S.C. 154(b) by 0 days.

(21) Appl. No.: 09/196,819

(22) Filed: Nov. 20, 1998

(30) Foreign Application Priority Data

Apr. 19, 1998 (AR) ..... 980101792

(51) Int. Cl.[7] ..... H01J 1/62

(52) U.S. Cl. ..... 313/483; 313/489; 313/484; 313/110

(58) Field of Search ..... 313/489, 25, 110, 313/112, 485, 486, 487, 493, 483, 484, 571, 567, 568, 569

(56) References Cited

U.S. PATENT DOCUMENTS 5,903,095 * 5/1999 Yoshida et al. ..... 313/485
5,932,960 * 8/1999 Terada et al. ..... 313/485
5,949,180 * 5/1999 Walker ..... 313/113

* cited by examiner

*Primary Examiner*—Vip Patel
*Assistant Examiner*—Joseph Williams
(74) *Attorney, Agent, or Firm*—Ware, Fressola, Van Der Sluys & Adolphson LLP

(57) ABSTRACT

This invention is essentially a device that, applied to a functioning lamp or fluorescent tube, creates an electric field, or ionized cavity (E), around the lamp or tube and thus impedes the additional energy dispersion that such lamps or fluorescent tubes normally discharge and lose in the form of ultraviolet radiation. From this follows a greater efficiency in the conversion of ultraviolet radiation into visible light, thus making this device an important tool for the saving of energy.

6 Claims, 3 Drawing Sheets

OPTIMIZING THE GENERATION OF VISIBLE LIGHT PRODUCED BY MERCURY ARC VAPOR AND FLUORESCENT LAMPS

CROSS-REFERENCE TO RELATED APPLICATIONS

A device with a similar effect in the generation of visible light from fluorescent tubes is described in U.S. Pat. No. 5,343,120 granted on Aug. 30, 1994 to the same inventor, Norberto Miguel Mulieri.

Another device, similar in appearance, but totally different in concept, application and effect is described in U.S. Pat. No. 4,048,537 granted on Sep. 13, 1977 to Blaisdell et al, and subsequently assigned to GTE Sylvania Inc., Salem, Mass. This device is a plastic sleeve for lamp protection against mechanical or impact damage which allows the transmission of ultraviolet radiation. The described device has nothing to do with the enhanced generation of visible light.

BACKGROUND OF THE INVENTION

It is well known that a considerable amount of electric energy is required by the illumination demands of a modern society resulting from the requirements for controlled highly illuminated environments. In spite of the advances in technology and current efficiency of gas discharge lamps, which are 80% more efficient than traditional incandescent lamps, additional savings in energy usage can be achieved by utilizing external devices. The measure of efficiency is Lumens per Watt (Lm/W), where Lumens is the measure of light generation and Watts represents the power input to the system to produce a given amount of light. A number of efforts have been made with external devices to the lamp as follows:

a) Increasing the efficiency (Lm/W) utilizing an electronic ballast to provide power to the lamp, resulting in considerable energy savings of approximately 21%, as compared to traditional electromagnetic ballasts.

b) Fixtures or devices with parabolic reflectors, with high gain aluminum plating that allow one to sensibly reduce the number of lamps that are needed for an installation, in comparison with the installation of older generation lights without such reflectors.

c) There also exists an Argentine patent for a device, No. 249642 (1996), which achieves the recycling (reflection) of ultraviolet radiation by use of a reflector specifically designed for ultraviolet radiation, thus attaining an increase in visible light.

All of these devices and improvement alleviate the critical situation that is presented by the increase in the consumption of energy for illumination and the consequent environmental impact.

The invention which is the subject of this Specification, is based on the creation of an "auto-generated electrical field" around the mercury discharge gas lamp and/or common fluorescent tube which greatly improves the Lm/W efficiency ratio. This invention also contributes to improving the mercury lamps' other discharge characteristics by reducing, by more than 70%, the ultraviolet radiation from the light spectrum that reaches the work surface, thus contributing to alleviating the environmental impact and the human health hazards related to ultraviolet radiation.

BACKGROUND OF THE INVENTION

This invention achieves an efficiency in the use of the ultraviolet radiation normally emitted by dispersion by mercury discharge lamps, such as fluorescent tubes. Such lamps generate ultraviolet radiation with a wavelength between 253.7 nm and to 380 nm (nanometers). The more efficient use of the ultraviolet radiation is achieved by placing a containment device (the invention) around the lamp or fluorescent tube, that creates an enclosed annular cavity between the fluorescent tube and the device and the formation of an electric field (E). The device is constructed in its current configuration by appropriately assembling the various elements described in this specification to create the ionized cavity in which the electric field (E) is formed.

Therefore, the objective of this invention is a device applicable to mercury discharge lamps in general, and fluorescent tubes in particular, which improves the Lm/W ratio increasing the amount of Lm/W as a result of a reduction in the dispersion of the ultraviolet radiation outside the mercury discharge lamp or fluorescent tube. This device and its result are unique and distinctive because the device consists of an inorganic closed transparent containment structure added to the mercury discharge lamp or fluorescent tube which contains a dielectric flexible sheet of organic crystal transparent material placed against the inside wall of the containment device. The gas between the mercury discharge lamp or fluorescent tube and the containment device is untreated normal atmospheric air. The containment device is closed off at both ends by semi-rigid caps made of an organic dielectric material, such as rubber or plastic, with circular concentric openings having a diameter and/or shape and dimensions equal to the external diameter of the mercury discharge lamp or fluorescent tube which the containment device will surround.

With this invention, the ultraviolet radiation is prevented from escaping and dispersing due to the presence of the ionized cavity and redirected back towards the lamp, which produces additional illumination. The invention can be better understood by referring to the figures in which one configuration of the device is described and presented.

BRIEF DESCRIPTION OF THE SEVERAL VIEWS OF THE FIGURES

As a non-limiting example.

DETAILED DESCRIPTION OF THE INVENTION

Figure 1A:
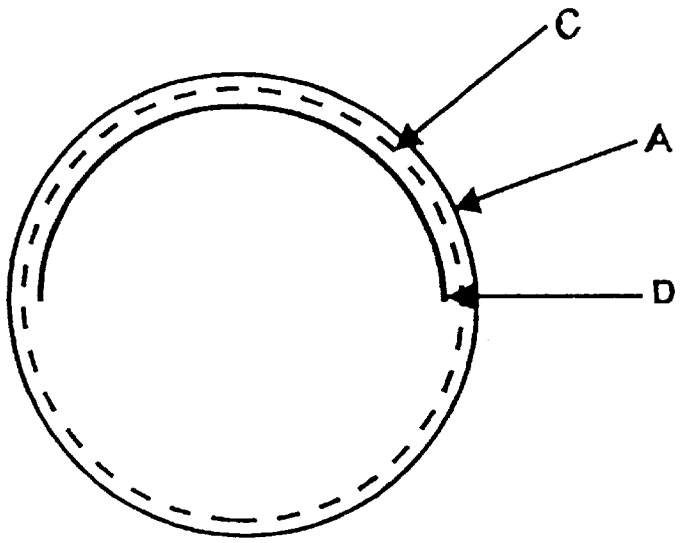
FIG. 1A, FIG. 1B and FIG. 1C show views of the various parts of the device, prior to assembly. This is a possible configuration of the device. The external structure (A) is of a transparent inorganic material such as glass, with an interior diameter larger than the external diameter of the fluorescent tube that it must enclose and hold. End caps (B) may be made of an organic material, such as rubber or plastic, with circular perforations of a diameter equal to the diameter of the fluorescent tube that is must hold or carry. A flexible dielectric reflector sheet of organic crystal transparent material (C), in a curved rectangular shape, whose surface area may be larger that the development of the inside surface area of the external structure (A), fits up against the interior surface of the external structure. The inside of the containment structure contains a non-conducting metallic surface reflector (D) along the entire length of the containment structure, supported by a transparent, dielectric, organic material.
Figure 1B:
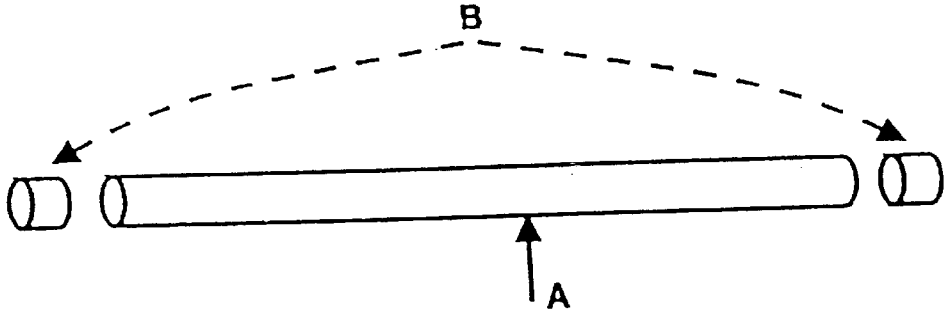
Figure 1C:
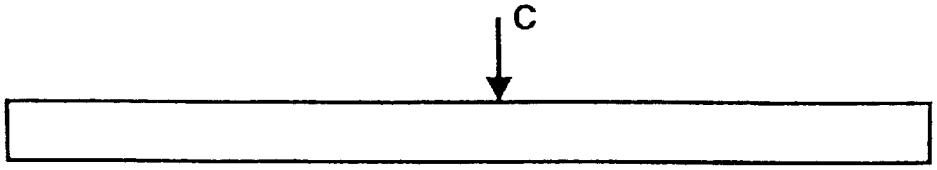
Figure 2:
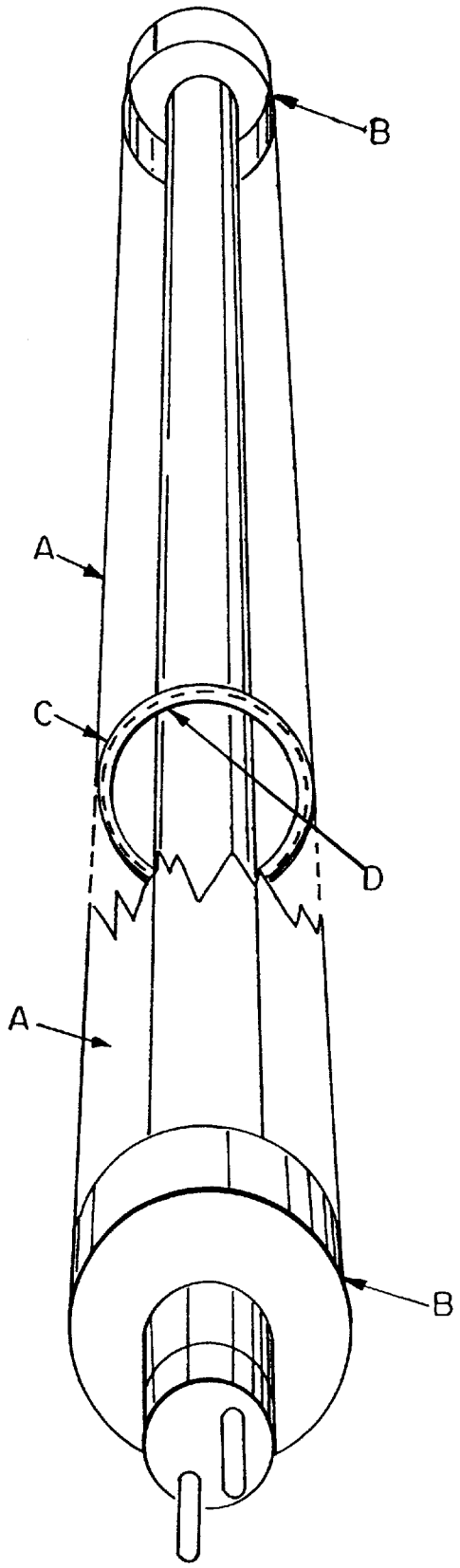
FIG. 2 shows the assembled device, as a non-limiting example, carrying a fluorescent tube in its interior.
Figure 3:
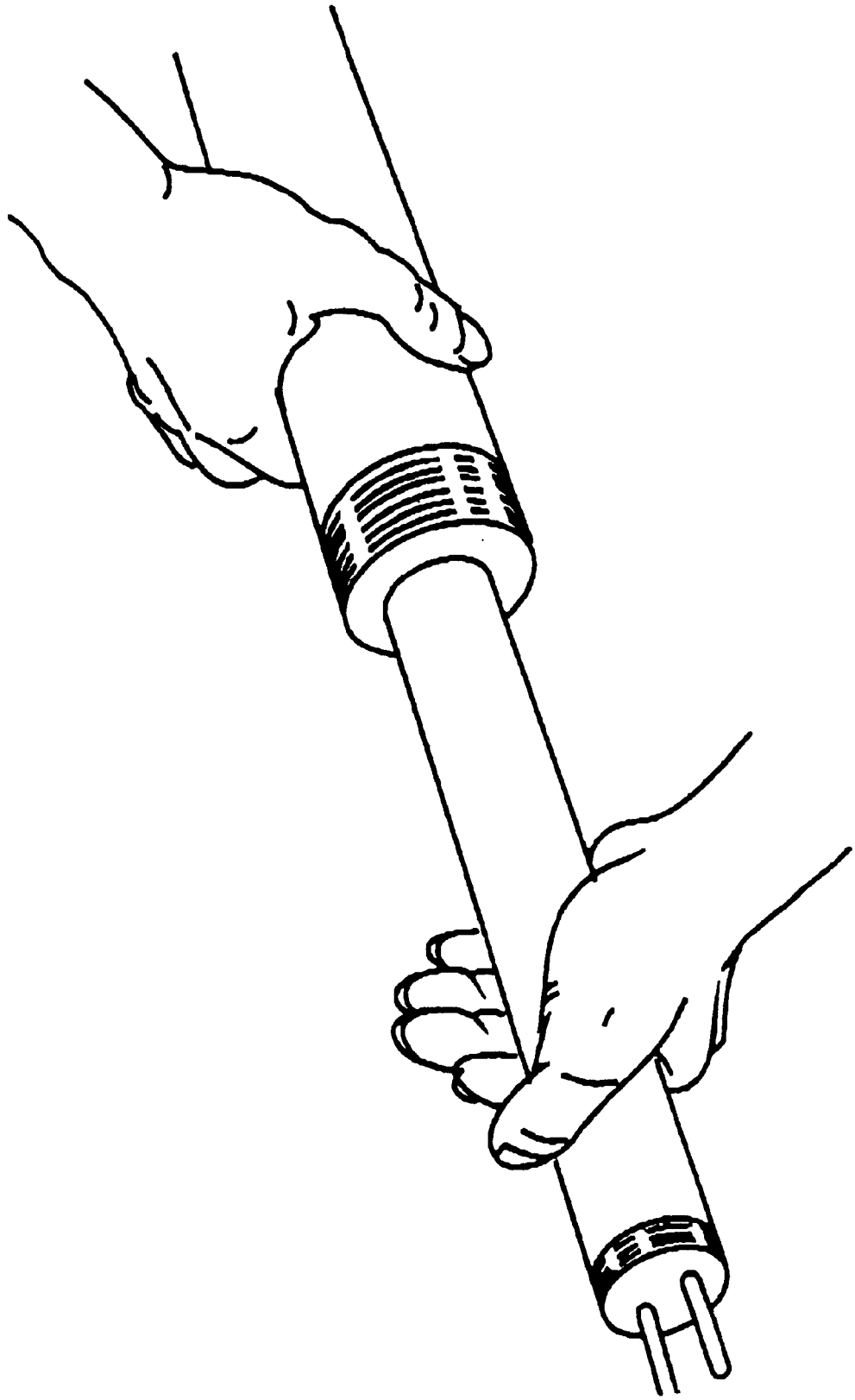
FIG. 3 shows how the fluorescent tube is placed in the device.

A device applicable to mercury gas discharge lamps and fluorescent tubes being constructed with an external structure of rigid, transparent, inorganic, and dielectric material (A), with shape and dimensions complementing the lamp or fluorescent tube with which the device will be used (which the device surrounds) and a dielectric flexible sheet (C) of organic crystal transparent material placed against the internal wall of the external structure (A) along its full length. The structure, or containment device, is closed at both ends by semi-rigid caps (B) of organic dielectric material, such as rubber or plastic, with circular openings of size and shape equivalent to the lamp or fluorescent tube which the device will hold or carry. Normal operation of a working lamp or fluorescent tube will result in the formation of an electric field (E) surrounding the lap or fluorescent tube, which is maintained by the ultraviolet (253.7 nm to 380 nm) radiation energy that passes through the wall of the lamp or fluorescent tube.

The inside of the containment structure contains a non-conducting metallic surface reflector (D) along the entire length of the containment structure, made of a transparent, dielectric, organic material. The reflector (D) covers up to 50% of the internal surface of the containment external structure (A) of the device and is placed inside the dielectric flexible sheet (C). The containment external structure (A), depending on the shape of the lamp or fluorescent tube, covers up to 96% of the surface of the lamp or fluorescent tube. The reflector (D) does not have direct physical contact with the lamp or fluorescent tube and should be placed at a minimum distance of 0.50 mm from the lamp or fluorescent tube. The reflector (D) must be separate from and not further distant than the optical focus of the lamp or fluorescent tube. Further, neither the containment external structure (A) nor the reflector (D) should be in contact with the lamp or fluorescent tube. Only the end caps (B) at the two ends of the may be in contact with the lamp or fluorescent tube.

The external structure (A) must be made of an inorganic material completely transparent and dielectric, such as glass, with a preferred wall thickness between 0.8 mm and 1.0 mm. The end caps may be opaque to light and should be made of a semi-rigid organic dielectric material, such as rubber or plastic.

On the interior of the external structure (A) of the device and conforming to the circular contour of the internal wall, the flexible, organic, dielectric sheet (C) is placed, forming a second covering of the entire internal surface of the rigid structure (A). This organic sheet should have a melting point higher than 150° C. (degrees Celsius) with optical characteristics of crystal transparency and with filtering materials for ultraviolet radiation in its composition. Its thickness may vary between 25 and 100 microns (depending on the technical aspects of the electric power supplied and the shape and configuration of the lamp with which the device is to be used). This sheet (C) must cover the entire internal surface of the external rigid structure (A) and can be overlapped and overlaid.

These three elements, assembled according to the above description, allow for the formation of an ionized cavity (E), that covers at least 96% of the external surface of the lamp or fluorescent tube. The inside diameter of the ionized cavity is formed by the external wall of the fluorescent tube or lamp and extends radially to the internal wall of the external structure (A), a distance no greater than 20 mm as measured on a radius that begins at the central axis of the fluorescent tube or cylindrical lamp. In the specific case of amorphous lamps, and depending on their power, the distance between the internal wall of the device and the external wall of the lamp should not be more than 30 mm and not less than 0.5 mm.

We present as a non-limiting example, the use of the device for fluorescent tubes. The electric field (E) is maintained by the discharge of energy from the excess ultraviolet radiation that escapes through the glass wall of the working fluorescent tube, creating a saturation of negatively charged gas particles in the ionized cavity (E), which in turn, prevents the further dispersion of the ultraviolet radiation or escape of certain monochromatic wavelengths of ultraviolet radiation in the range between 253.7 nm and 380 nm, which are then redirected back to the layer of fluorescent material that covers the internal wall of the fluorescent tube producing additional visible light.

The mechanism (phenomenon) is explained only to understand briefly in a summary first phase manner the operation of this invention. The electrical field (E) creates a resistance or opposition to discharge (radiation) towards the exterior (and loss of primary energy) for some of the wavelengths of ultraviolet radiation. This creates a disequilibrium in the mercury (Hg) atoms that, in a "metastable" stage, are abundant in the ionized cylinder inside the fluorescent tube, passing the state of "resonance" (253.7 nm) which increases the generation in the emission of ultraviolet radiation and its corresponding conversion to visible light. The aforesaid is observed through the measurement made by a marked increase in visible light and a quantitative and qualitative change (decrease) in the emissions of ultraviolet radiation in the spectrum of 253.7 nm to 380 nm.

Events (Observations) Produced by the Presence of the Electric Field (E) Maintained Without Interruption in the Ionized Cavity Around a Functioning Fluorescent Tube This increase in visible light must be compensated for by rearranging the original characteristics of photoluminous distribution of the lamp, as affected by the device, with the introduction of a high gain (98%) reflector inside the cavity of the device which, conforming to the arc of the internal semi-cylinder of the device, does not exceed 50% of the internal surface of the cylinder. The presence of the reflector (D) is necessary in order to correct reflections produced by the internal surfaces of the device that deflect the visible light increasing negative or destructive interference.

The reflector (D) is placed just inside the cavity created by the organic, dielectric, flexible sheet (C) and leans against this sheet. The reflector (D) has a crystal coating of transparent, insulating resin applied on its reflective metallic surface, so that the conductivity of the reflective surface is insulated and does not allow the break-up of the electric field (E) charges that surround the fluorescent tube or lamp.

It is essential (sine qua non) that the device not be grounded and that the dielectric characteristics of its materials prevent losses or grounding discharges, so therefore they must be stable dielectrics at the temperatures and frequencies they are exposed to, and to keep a relative position with regard to its grounded environment (luminaire, light fixture, etc.) so as to not have physical contact except with surrounding air.

What I claim as my invention is as follows (What is claimed):

1. A device applicable to mercury gas discharge and fluorescent lamps of the type which generate ultra violet radiation (253.7 nm to 380 nm) to interact with fluorescent particles covering an internal wall of the lamp to produce visible light, said device comprising:

an external structure of rigid, transparent, inorganic and dielectric material (A), with shape and dimensions conforming to a lamp to be used, said structure (A) being open to permit insertion of a lamp;

within structure (A), a reflector (D) comprising a metallic reflective surface insulated against electricity along its length by a transparent, dielectric, organic material, the reflector (D) covering up to 50% of the internal surface of the inside wall of structure (A); and end cap means (B) of semi-rigid dielectric material to close structure (A) and holds a lamp within structure (A) and spaced from reflector (D) a distance less than the optical focus with reference to the lamp;

whereby, the device, when surrounding a working lamp, will cause the spontaneous formation of an electric field (E) between the device and the lamp, the electric field (E) being maintained by the ultraviolet radiation (253.7 nm to 380 nm) dispersed through the wall of the lamp, until reaching a saturation level that hinders the further dispersion of the ultra violet radiation, which in turn induces a greater flow and discharge of the ultraviolet radiation onto the fluorescent particles that cover the internal wall of the lamp, resulting in an increase in the emission of visible light and an improvement in Lumens generated per Watt.

2. The device, according to claim 1, in which the position of the device is asymmetric in relation to the lamp.

3. The device, according to claims 1 or 2, in which the device or its internal components can be rotated axially in relation to the lamp up to 360 degrees.

4. The device, according to claims 1 or 3, further including internally of structure (A) a dielectric, flexible sheet (C) or organic crystal transparent material placed against the internal wall of the external structure (A) along the entire internal surface for the case in which the reflector (D) covers less that 50% of the internal surface of the structure (A).

5. A device applicable to lamps of fluorescent and mercury gas discharge types which generate ultra violet radiation (253.7 nm to 380 nm) to interact with fluorescent particles covering an internal wall of the lamp to produce visible light, said device comprising:

an external structure of rigid, transparent, inorganic and dielectric material (A), with shape and dimensions conforming to a lamp to be used, said structure (A) being open to permit insertion of a lamp;

within structure (A), a reflector (D) comprising a metallic reflective surface insulated against electricity along its length by a transparent, dielectric, organic material, the reflector (D) covering up to 50% of the internal surface of the inside wall of structure (A);

internally of structure (A) a dielectric, flexible sheet (C) or organic crystal transparent material which holds in place the reflector (D) placed against the internal wall of the external structure (A) along the entire internal surface; and end cap means (B) of semi-rigid dielectric material to close structure (A) and hold a lamp within structure (A) and spaced from reflector (D) a distance less than the optical focus with reference to the lamp;

whereby, the device, when surrounding a working lamp, will cause the spontaneous formation of an electric field (E) between the device and the lamp, the electric field (E) being maintained by the ultraviolet radiation dispersed through the wall of the lamp, until reaching a saturation level that hinders the further dispersion of the ultra violet radiation, which in turn induces a greater flow and discharge of the ultraviolet radiation onto the fluorescent particles that cover the internal wall of the lamp, resulting in an increase in the emission of visible light and an improvement in Lumens generated per Watt.

6. Increasing the efficiency of energy utilization by mercury arc vapor and fluorescent lamps, comprising:

providing a mercury arc vapor or fluorescent lamp of the type which generate ultra violet radiation (253.7 nm to 380 nm) that interacts with fluorescent particles covering an internal wall of the lamp to produce visible light;

placing around said lamp an external structure of rigid, transparent, inorganic and dielectric material (A), with shape and dimensions conforming to the lamp, said structure (A) being open to permit insertion of the lamp;

providing within structure (A), a reflector (D) comprising a metallic reflective surface insulated against electricity along its length by a transparent, dielectric, organic material, the reflector (D) covering up to 50% of the internal surface of the inside wall of structure (A); and providing end cap means (B) of semi-rigid dielectric material to close structure (A) and hold the lamp within structure (A) and spaced from reflector (D) a distance less than the optical focus with reference to the lamp;

whereby, an electric field (E) is formed between the device and the lamp, the electric field (E) being maintained by ultraviolet radiation dispersed through the wall of the lamp, until reaching a saturation level that hinders further dispersion of ultra violet radiation, which in turn induces a greater flow and discharge of ultraviolet radiation onto the fluorescent particles that cover the internal wall of the lamp and results in increased emission of visible light.

* * * * *